United States Patent [19]

Iwano

[11] Patent Number: 4,954,425

[45] Date of Patent: Sep. 4, 1990

[54] METHOD FOR FORMING INTENSIFIED COLOR IMAGE

[75] Inventor: Haruhiko Iwano, Minami-ashigara, Japan

[73] Assignee: Fuji Photo Film Co., Ltd., Kanagawa, Japan

[21] Appl. No.: 232,253

[22] Filed: Aug. 15, 1988

[30] Foreign Application Priority Data

Aug. 13, 1987 [JP] Japan ..... 62-200856

[51] Int. Cl.[5] ..... G03C 7/40; G03C 7/26; G03C 7/30

[52] U.S. Cl. ..... 430/373; 430/418; 430/434; 430/461; 430/464; 430/467; 430/469; 430/483; 430/489; 430/567; 430/943

[58] Field of Search ..... 430/373, 386, 418, 434, 430/461, 464, 467, 469, 483, 486, 489, 943, 567

[56] References Cited

U.S. PATENT DOCUMENTS

| | | | |
|---|---|---|---|
| 4,045,225 | 8/1977 | Shimamura et al. | 430/943 |
| 4,062,684 | 12/1977 | Hara et al. | 430/373 |
| 4,094,682 | 6/1978 | Fujiwhara et al. | 430/943 |
| 4,414,305 | 11/1983 | Nakamura et al. | 430/373 |
| 4,469,780 | 9/1984 | Hirai et al. | 430/373 |
| 4,529,687 | 7/1985 | Hirai et al. | 430/373 |
| 4,564,591 | 1/1986 | Tanaka et al. | 430/567 |
| 4,590,155 | 3/1986 | Klotzer | 430/567 |
| 4,605,610 | 8/1986 | Klutzer | 430/567 |

*Primary Examiner*—Paul R. Michl
*Assistant Examiner*—Patrick A. Doody
*Attorney, Agent, or Firm*—Sughrue, Mion, Zinn, Macpeak & Seas

[57] ABSTRACT

A method for forming an intensified color image by subjecting a silver halide color photographic material exposed imagewise to light, to color-development processing that uses a monobath development-intensifying solution containing hydrogen peroxide or a compound that releases hydrogen peroixide and a color-developing agent is disclosed. According to the color-intensifying method silver-saving can be attained using a greatly reduced amount of a processing solution.

15 Claims, 1 Drawing Sheet

METHOD FOR FORMING INTENSIFIED COLOR IMAGE

BACKGROUND OF THE INVENTION (1) Field of the Invention

The present invention relates to an improved method for color-intensifying in color photography, and more particularly, to a color-intensifying method for saving silver in color photography development, using a largely reduced amount of a processing solution.

(2) Description of Prior Art

A color-intensifying method has already been disclosed in detail in JP-A ("JP-A" means unexamined published Japanese patent application) Nos. 9728/1973, 9729/1973, 53826/1976, and 73731/1977, U.S. Pat. No. 3,816,134, and JP-A Nos. 13335/1977, and 127555/1980, and in particular, since the method of intensifying a photographic image in the presence of a nitrogen-containing compound that uses a peroxide, such as hydrogen peroxide, and a processing solution substantially free from iodide ions or bromide ions is high in the effect of intensifying a photographic image, an improvement thereof has been made by the instant inventors.

That is, after JP-A No. 18629/1983 filed by the inventors disclosed the above technique, improvements that include the omission of the washing step after the color-intensifying step (JP-A Nos. 137837/1983 and 127926/1983), improvements in various methods wherein intensifying processing solutions are applied to photographic materials (JP-A Nos. 80150/1986, 80149/1986, and 77851/1986), and improvements in steps of further increasing the image-intensification effect (JP-A No. 88259/1986) were made.

A major problem associated with the above prior techniques resides in that the image-intensification ratio changes conspicuously depend on the type and concentration of the halide ions involved. In other words, when iodide ions or bromide ions are present in the processing solution, the intensification effect decreases remarkably. However, a reducing solution free from iodide ions or bromide ions is not practical because such a solution causes great fogging in the photographic material. The inventors previously found that a nitrogen-containing heterocyclic compound can suppress fogging effectively without lowering the intensification effect (in some cases a nitrogen-containing heterocyclic compound rather improves the intensification effect), and suggested a method of intensifying a photographic image without causing fogging even when the processing solution does not contain iodide ions or bromide ions (JP-A No. 18629/1983). The photographic materials to which this technique is applied had no particular limitations on the halide composition of sliver salts, such as silver bromoiodide, silver bromide, silver chlorobromide, and silver chloride. This is because generally for the usual proportion of the amount of the photographic material to be processed to the amount of processing solution to be used, the amount of halide resulting from the photographic material for intensifying colors that contains less silver that has been applied is not enough to influence the halide concentration in the processing solution.

On the other hand, for the color-intensifying method disclosed in JP-A No. 18629/1983 suggested by the instant inventors, it could not be said that the processing solution has sufficient stability with time, because an oxidizing agent and a reducing agent are present in a single processing bath. With respect to the improvement in this stability with time, it is known that if an alkyl phosphonic acid, for example, typically hydroxyethane diphosphonic acid, a phosponocarboxylic acid, or an aromatic sulfonic acid is used, the life of the processing solution can be prolonged. It is also well known that when the processing solution in a processing tank is replaced with fresh processing solution, with the replacing ratio being high, its exhausting with time can be reduced. That is, when the replenishing solution is increased to increase the replacing ratio, and in an extreme case, when it is possible to discard the processing solution, the problem can be solved easily, but in that instance the amount of processing solution used will increase, which is less economical. However, the prior techniques could not help discarding the processing solution in the color-intensifying process for the stability of the processing solution, even though it was economically disadvantageous.

Therefore, the color intensification in the practical form involves discarding the processing solution, or keeping the processing solution replacing ratio high for continuous processing accompanied by replenishing. As means of decreasing the amount of processing solution to be used in this state, it is considered to make the processing tank smaller in discarding-type processing and in replenishing-type processing, which results in lowering the intensification effect of the photographic image. In other words, it was difficult to solve both the problem of exhausting of the processing solution and the problem of preventing the image intensification ratio from lowering.

BRIEF SUMMARY OF THE INVENTION

An object of the present invention is to provide a monobath type color-intensifying method wherein the amount of processing solution to be used can be reduced without lowering the image intensification effect with the processing time.

Another object of the present invention is to provide an economical method of forming color images wherein although the coating amount of silver is quite small, a color image density that is sufficiently high can be exhibited, and the processing solution is less consumed.

A still further object of the present invention is to provide a simple and quick method of forming color images that requires fewer processing steps.

Other and further objects, features and advantages of the invention will appear more fully by referring to the following description and appended drawings.

DETAILED DESCRIPTION OF THE INVENTION

Figure 1:
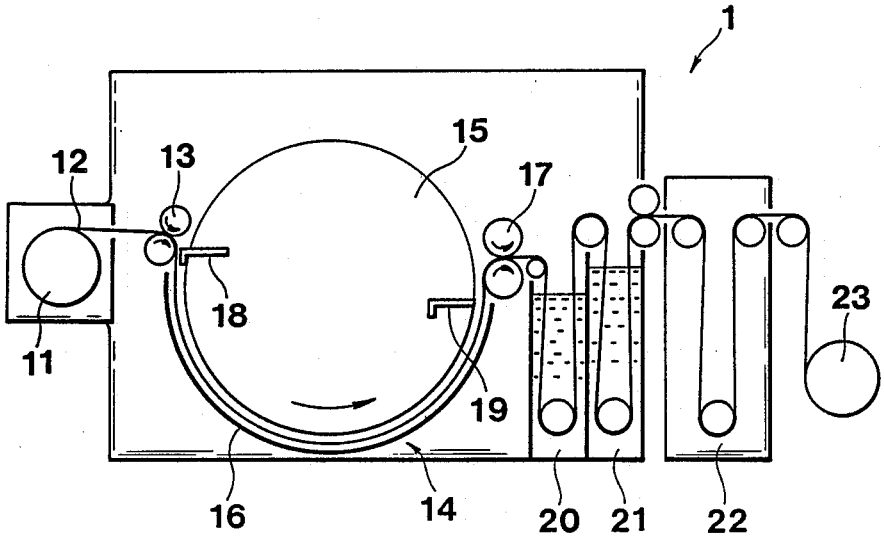
FIG. 1 is a schematic view showing a photographic processing apparatus suitable for use for practicing the present invention.

The inventors have studied intensively to attain the above objects and have found that in a monobath color-intensifying method, generally, when the amount of a color-intensifying solution to be used per unit area of photographic material is reduced, the image intensification effect is also reduced, resulting in the loss of practicability, while on the contrary if a method of forming color images by color development processing that uses a monobath development-intensifying solution free from bromide ions and iodide ions is employed with a photographic material being used whose photosensitive body is an emulsion high in silver content, economical processing becomes possible without lowering the image intensifying property even if the processing solution to be used is small, based on which the present invention has been accomplished.

Therefore, the present invention provides a method of forming a color image, with the color image intensified, by subjecting a silver halide color photographic material, which has been exposed imagewise to light, to color-development processing that uses a monobath development-intensifying solution containing hydrogen peroxide or a compound that releases hydrogen peroxide and a color-developing agent, and substantially free from bromide ions and iodide ions, in which method a silver halide color photographic material substantially free from silver iodide as photosensitive silver halide and containing 80 mol % or more of silver chloride is used, and the amount of the monobath intensifying solution to be used is up to 5 l but down to 0.05 l per $m^2$ of the photographic material.

The silver halide emulsion consisting substantially of a silver halide that is used in the present invention is substantially free from silver iodide, and consists of a silver halide containing 80 mol % or more of silver chloride. Preferably the content of silver chloride is 90 mol % or more, and more preferably 95 mol %, and pure silver chloride is particularly preferably used (hereinafter, such a silver halide used in the present invention will be referred to simply as "silver chloride").

In detail, the wording "substantially free from silver iodide" means the following: in spectral sensitization with a cyanine dye, to enhance the adsorption onto a silver halide or the formation of J-association, thereby providing higher spectral sensitization, a water-soluble iodide salt such as potassium iodide is often used in a trace amount of 0.5 mol % or less per mol of a silver halide, and in that case it is well known that a silver iodide part is formed near the silver halide surface due to the added iodide salt, and that the content of silver iodide including the thus-formed silver iodide should be no higher than 1 mol %, preferably no higher than 0.5 mol %, and most preferably none at all.

In the present invention, the amount of monobath-intensifying solution to be used means, when the process is effected using the replenishing system, the replenishing amount irrespective of the volume of the processing solution in the processing tank, and when the discarding system is used, the amount of the processing solution required to fill the processing tank in each processing.

If a large amount of processing solution is used, disregarding economy, no problems arise, but if the amount of the processing solution is 5 l or less per $m^2$ of the photosensitive material, it is generally observed that the image intensification ratio is lowered in a conventional method. However, in the method of the present invention such a harmful effect would not occur. Therefore, in the method of the present invention the amount of processing solution can be saved. For a case of a silver halide other than silver chloride, the image intensification ratio, is lowered more as the amount of processing solution used is smaller, while in the method of the present invention, since the decrease in the amount of processing solution to be used has little influence, the effect of the present invention becomes more remarkable as the amount of solution used is lowered. Therefore, it is more preferable that the amount of solution to be used is up to 1 l but down to 0.05 l per $m^2$ of the photographic material. Although the method of the present invention is more suitable for the discarding system, if the method is used for the replenishing system, preferably a large amount of a photographic material is processed continuously with the solution-replacing ratio of the tank solution being 2 times or more per hour (that is, with the replenishing amount during continuous processing being 2 times or more as large as the tank volume), more preferably 3 times or more per hour, and further more preferably 4 times or more per hour. To materialize such a high solution-replacing ratio in the replenishing system, the tank volume must be made sufficiently small, but if the amount of photographic material to be processed is not so large as to attain such a solution-replacing ratio, it is rather desirable to carry out the discarding process. Even in this case, the processing tank and the processing system can be configurated readily for the person skilled in the art, in order to allow the solution that is used to be as little as 5 l or less per $m^2$ of the photographic material.

In the present invention, the preferable amount of intensifying solution to be used is, for example, 0.05 to 0.5 l in a coating development by a discarding system, 0.08 to 1 l in an immersing development by a replenishing system, and 0.5 to 3 l in an immersing development by a discarding system, respectively, per $m^2$ of the photographic material. Among the above, the coating development by discarding system and the immersing development by replenishing system are more preferable.

As a specific example, in the tray development using a vat that is a typical case of the discarding system, processing solution is used conventionally in an amount of 10 to 20 l per $m^2$ of the photographic material. The tank for 35 mm film (135 format) also uses 10 l per $m^2$. Therefore, an amount of 5 l per $m^2$ can be seen as a considerably small amount in the discarding process wherein the solution is discarded each time. On the other hand, if the development is carried out by the replenishing system, since generally the amount is on the order of 0.5 to 2 l per $m^2$ in most cases, economical processing with the processing solution saved becomes possible when the processing is excellent in stability with time.

As the processing system to which the present invention can be applied, any one of known systems for performing monobath type color-intensifying processing can be used, and the present invention is not limited to such known systems. Preferable processing systems include the following:

(A) Laminar flow development as disclosed in JP-A No. 77851/1986

Laminar flow development is a mode wherein a monobath development-intensifying solution is acted in such a way that the monobath development-intensifying solution keeps a laminar flow state or a static nonstirred state with the monobath development-intensifying solution in contact with the photographic material, and the monobath development-intensifying solution exhibits a laminar flow state not to allow the development-intensifying solution to be used repeatedly, and laminar flow development includes many types.

For example, there is a process wherein a liquid film is formed into the form of a ring defined between the circumferential surfaces of two concentric drums, and a photographic material in the form of a roll is dipped along the circumferential surfaces. As this type of process there are a batch-type processing method, wherein a photographic material is secured to a drum and after the processing solution is quickly fed, the liquid is made still; and a continuous processing method, wherein a photosensitive material and a processing solution are fed from one end of the drum, their relative speeds are made sufficiently slow, the photographic material is removed from the other end, and the used processing solution is overflowed.

(B) Coating development disclosed in JP-A No. 80149/1986

Coating development is a method wherein, in the development-intensifying processing, a development-intensifying solution is applied onto a silver halide color photographic material that has been exposed to light imagewise with the development-intensifying solution formed into a liquid film.

In this method, preferably a first solution containing a color-developing agent, and a second solution containing hydrogen peroxide or a compound that releases hydrogen peroxide are prepared separately, and either the first solution and the second solution are applied separately successively, or the first solution and the second solution are mixed immediately before the application, thereby preparing a single solution, followed by the application of the single solution.

(C) Spraying development as disclosed in JP-A No. 80150/1986

Spraying development is a method wherein a silver halide color photographic material that has been exposed to light imagewise is sprayed with a development-intensifying solution.

In this method, preferably a first solution containing a color-developing agent, and a second solution containing hydrogen peroxide or a compound that releases hydrogen peroxide are prepared separately, and either the first solution and the second solution are sprayed simultaneously or successively, or the first solution and the second solution are mixed immediately before the spraying, thereby preparing a single solution, followed by spraying with the single solution.

(D) Other developing method

This method is a thin-layer development similar to the laminar flow development, but contrary to the laminar flow development, intensive turbulent stirring is provided in this method, so that processing that uses a small amount of the processing solution can be performed with uneven development being prevented.

For instance, there is a process wherein a color-intensifying solution is introduced onto a photographic material with the thickness of the solution being 1 to 2 mm, and a brush is moved alternately backward and forward on the photosensitive film to stir the solution, or the developing container is shaken.

In short, it is acceptable if development can be carried out uniformly and effectively by using a small amount of processing solution.

Preferably the pH of the monobath development-intensifying solution used in the present invention is 9 or higher, and more preferably 10 to 12.

The monobath development intensifying solution of the present invention contains hydrogen peroxide or a compound that releases hydrogen peroxide (e.g. percarbonic acid and perboric acid), and a color-developing agent. As the color-developing agent used in the present invention can be mentioned p-phenylenediamine derivative color-developing agents, p-aminophenol derivative color-developing agents of the onium salt type described, for example, in U.S. Pat. No. 3,791,827, dye developers described, for example, in U.S. Pat. No. 2,983,606, diffusible dye-releasing type (DDR) redox compounds described in JP-A No. 33826/1973, developing agents reactive with amidrazone compounds described, for example, in JP-B ("JP-B" means examined Japanese patent publication) No. 39165/1973, reducing agents (e.g. tetrazonium salts, 2,4-diaminophenol, and $\alpha$-nitroso-$\beta$-naphthol leuco dyes) of a type that themselves are oxidized to form dyes or lakes, and reducing agents that can form a colored image after oxidized as described in JP-A No. 6338/1972, pages 4 to 13. Specifically, the reducing agent is a developing agent, and to form a dye, itself is oxidized to couple with a coupler, itself is oxidized to form a dye, or itself is previously colored and when it is oxidized it becomes a non-diffusible dye.

As preferable typical examples of p-phenylenediamine derivative color-developing agents can be mentioned 2-amino-5-diethylaminotoluene hydrochloride, 2-amino-5-(N-ethyl-N-laurylamino)toluene, 4-[N-ethyl-N-($\beta$-hydroxyethyl)amino]aniline sulfate, 2-methyl-4-[N-ethyl-N-($\beta$-hydroxyethyl)amino]aniline sulfate, N-ethyl-N-($\beta$-methanesulfoamidoethyl)-3-methyl-4-aminoaniline sesquisulfate monohydrate described in U.S. Pat. No. 2,193,015, N-(2-amino-5-diethylaminophenylethyl)methanesulfonamide sulfate described in U.S. Pat. No. 2,592,364, N,N-dimethyl-p-phenylenediamine hydrochloride, and 4-amino-3-methyl-N-ethyl-N-methoxyethylaniline, 4-amino-3-methyl-N-ethyl-N-ethyl-N -$\beta$-ethoxyethylaniline, and 4-amino-3-methyl-N-ethyl-N-$\beta$-butoxyethylaniline, and their salts (e.g., sulfates, hydrochlorides, sulfites, and p-toluenesulfonates) described, for example, in U.S. Pat. Nos. 3,656,950 and 3,698,525.

Those described by L. F. A. Mason in Photographic Processing Chemistry (published by Focal Press, 1966), pages 226 to 229 can also be used.

The amount of the color developing agent to be added is $10^{-3}$ mol/l or more, and preferably $2\times10^{-3}$ to $10^{-1}$ mol/l. It is desired that hydrogen peroxide or a compound that releases hydrogen peroxide is added to the color-developing agent with the molar ratio of the hydrogen peroxide or the compound to the color-developing agent being 0.5 to 200, and preferably 1 to 80. It is preferred that bromide ions or iodide ions are not contained at all, but if the amount of bromide ions is on the order of $2\times10^{-4}$ mol/l or the amount of iodide ions is on the order of $3\times10^{-3}$ mol/l, they are allowable. The monobath development-intensifying solution of the present invention may contain as a compound, which can react with or can be adsorbed onto a silver halide, a nitrogen-containing heterocyclic compound described in JP-A No. 8629/1983. This nitrogen-containing heterocyclic compound may be contained in the silver halide photographic material, or it may be contained both in the monobath development intensifying solution and in the silver halide photographic material.

Preferable nitrogen-containing heterocyclic compounds used in the present invention are (a) 5- or 6-membered heterocyclic compounds containing a nitrogen atom; (b) their derivatives having condensed rings; and (c) nitrogen-containing heterocyclic compounds represented by the following formulae (I) and (II):

Formula (I)

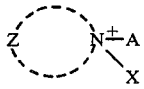

Formula (II)

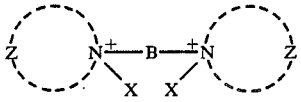

In formulae (I) and (II), A represents a substituted or unsubstituted alkyl group, alkenyl group, or alkynyl group, having 1 to 5 carbon atoms; an aralkyl group or cycloaliphatic hydrocarbon group, having 7 to 12 carbon atoms; or a substituted or unsubstituted aryl group having 6 to 12 carbon atoms; B represents a substituted or unsubstituted divalent hydrocarbon group, such as $-(CH_2)_n-$, $-CH_2O-(CH_2)_n-O-CH_2-$,

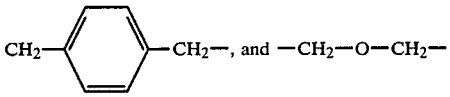

in which n is an integer of 1 to 12; X represents an anion excluding I (e.g., a Cl ion, a p-toluene sulfonate ion, or an alkyl sulfonate ion); and Z represents a group of nonmetals such as carbon atoms, oxygen atoms, and sulfur atoms that form together with the nitrogen atom a heterocyclic ring.

Preferable examples of the 5- or 6-membered heterocyclic compounds containing a nitrogen atom and their condensed rings mentioned under (a) and (b) above can be represented by the following formulae:

Formula (III)

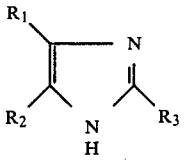

Formula (IV)

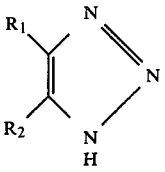

Formula (V)

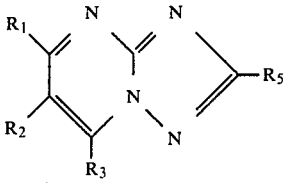

-continued

Formula (VI)

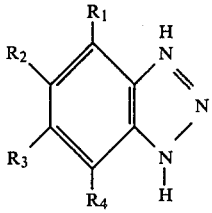

Formula (VII)

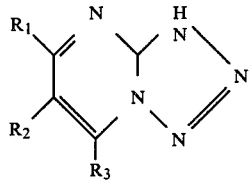

Formula (VIII)

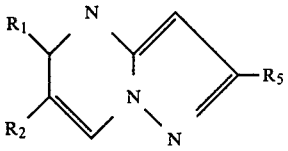

Formula (IX)

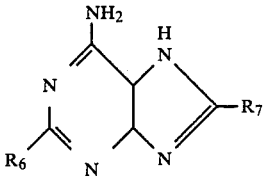

Formula (X)

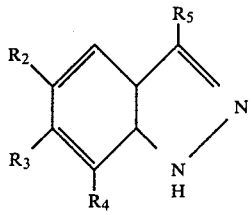

Formula (XI)

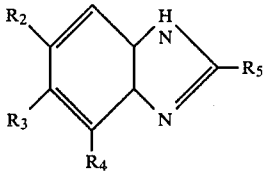

Formula (XII)

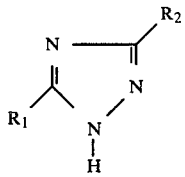

Formula (XIII)

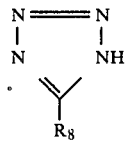

-continued

Formula (XIV)

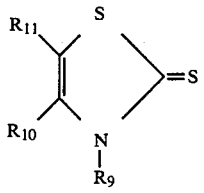

In formulae (III) to (XIV), $R_1$, $R_2$, $R_3$, and $R_4$ each represent a hydrogen atom, an alkyl group, an aralkyl group, an alkenyl group, an alkoxy group, an aryl group, —NRR′, —COOR, —$SO_3M$, —CONRR′, —$NHSO_2R$, —$SO_2NRR'$, —$NO_2$, a halogen atom, —CN, or —OH, in which R and R′ each represent a hydrogen atom, an alkyl group, an aryl group, or an aralkyl group, and M represents a hydrogen atom, or an alkali metal atom, and if $R_1$ and $R_2$ are alkyl groups they may be bonded to form an aliphatic carbon ring, $R_5$ represents a hydrogen atom, an alkyl group having 1 to 5 carbon atom, or a group —S—R″, in which group R″ represents a hydrogen atom, an alkyl group, an aryl group, or an aralkyl group, $R_6$ represents a hydrogen atom or an aralkyl group, $R_7$ represents a hydrogen atom, an alkyl group, or an aryl group, $R_8$ represents an alkyl group, an aryl group, a benzyl group, or a pyridyl group, $R_9$ represents an alkyl group, an alkenyl group, or an aryl group, $R_{10}$, and $R_{11}$ each represent an alkyl group, an alkenyl group, or an aryl group, and if $R_{10}$ and $R_{11}$ are alkyl groups, they may be bonded to form an aromatic ring.

Preferably, nitrogen-containing heterocyclic compounds having a mercapto group are compounds represented by the following formula:

Formula (XV)

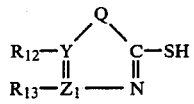

In formula (XV), Q represents an oxygen atom, a sulfur atom, or a group —NR‴, in which R‴ represents a hydrogen atom, an alkyl group, an unsaturated alkyl group, or a substituted or unsubstituted aryl group or aralkyl group; Y and $Z_1$ each represent a carbon atom or a nitrogen atom; $R_{12}$ and $R_{13}$ each represent a hydrogen atom, an alkyl group, an unsaturated alkyl group, a saturated or unsaturated aryl group, a saturated or unsaturated aralkyl group, —SR⁗, or —$NH_2$, in which R⁗ represents a hydrogen atom, an alkyl group, an aryl group, an aralkyl group, an alkyl carboxylic acid group or its alkali metal salt group, or an alkyl sulfonic acid group or its alkali metal salt group; and if Y and $Z_1$ both are carbon atoms, $R_{12}$ and $R_{13}$ may form a substituted or unsubstituted aromatic ring.

In formulae (III) to (XV), if $R_1$ to $R_{13}$ represent an alkyl group, an alkenyl group or an alkoxy group, preferably the number of carbon atoms is 1 to 5; if they are an aryl group, preferably the number of carbon atoms is 6 to 12; and if they are an aralkyl group, preferably the number of carbon atoms is 7 to 12.

Typical specific examples of the compounds according to the present invention are:

(1)

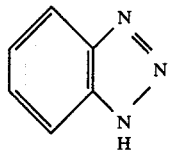

(2)

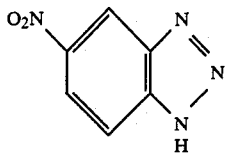

(3)

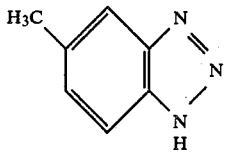

(4)

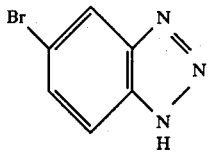

(5)

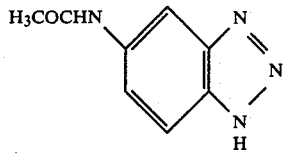

(6)

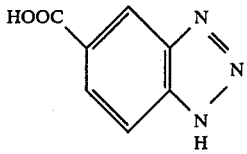

(7)

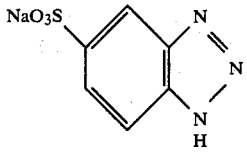

(8)

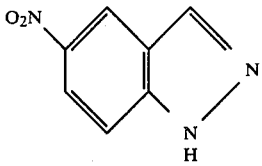

(9)

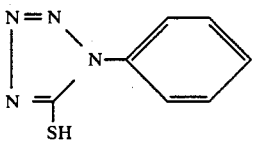

-continued (10)

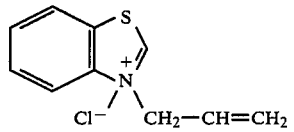

(11)

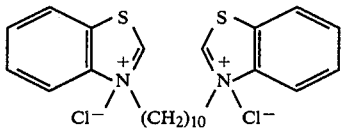

(12)

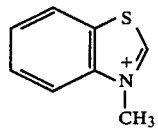

$4\text{-}CH_3C_6H_4SO_3^-$ (13)

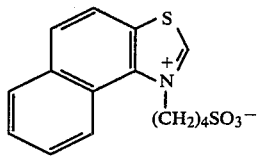

Two or more of these nitrogen-containing heterocyclic compounds may be used together.

The amount of these nitrogen containing heterocyclic compounds having a fogging-preventive effect to be added to the development-intensifying solution is dependent on the composition of silver chloride in the used low-silver photographic element, the coating amount of silver and the type of the above-mentioned compounds having a fogging-preventive effect, and although said amount is not particularly limited, it is preferable to add the nitrogen-containing heterocyclic compounds in an amount of 1/10 of the amount that is usually added to a common developing solution or a common intensifying solution. The nitrogen-containing heterocyclic compound is added in an amount in the range of $1\times10^{-7}$ mol to $1\times10^{-2}$ mol, preferably $1\times10^{-6}$ mol to $1\times10^{-3}$ mol, and more preferably $2\times10^{-6}$ to $1\times10^{-4}$ mol per liter of the development-intensifying solution. If the nitrogen-containing heterocyclic compound is added to a silver halide photographic material, it is added in an amount in the range of $10^{-8}$ to $10^{-2}$ mol, and preferably $10^{-7}$ to $10^{-}$mol, per $m^2$ of the photographic material.

If required, to the development-intensifying solution may be added an arbitrary development accelerator such as neutral salts, for example thallium nitrate and potassium nitrate; cationic dyes, for example phenosafranine, pyridinium compounds and other cationic compounds described for example in U.S. Pat. No. 2,648,604, JP-B No. 9503/1969, and U.S. Pat. No. 3,671,247; nonionic compounds, such as polyethylene glycols and their derivatives and polythioethers described in JP-B No. 9504/1969, U.S. Pat. Nos. 2,533,990, 2,531,832, 2,950,470, and 2,577,127; organic amines and organic solvents described in JP-B No. 9509/1969, and Belgium Patent No. 682,862; accelerators described by L. F. A. Mason in *Photographic Processing Chemistry*, pages 40 to 43 (Focal Press, London, 1966); phenylethyl alcohol and benzyl alcohol described in U.S. Pat. No. 2,515,147; and amines, hydrazines, ammonia, and pyridines described in *Nihon Shashin Gakkai-shi*, Vol. 14, page 74 (1952).

Further, sulfate or hydrochloride of hydroxylamine, sodium sulfite, potassium sulfite, potassium bisulfite, or sodium bisulfite may be added.

Although usual photographing materials contain silver salts in an amount of 10 $g/m^2$ in terms of silver, and even printing materials contain about 0.7 to 4 $g/m^2$ in terms of silver, in the photographic material to which the present invention will be applied, the coating amount of silver may be 1 $g/m^2$ or below, preferably 0.5 $g/m^2$ or below, and more preferably 0.2 $g/m^2$ or below, down to 0.01 g $m^2$. In the case of multi-layer photographic materials, the coating amount of silver per photographic layer within one spectrum range is 0.5 $g/m^2$ or below, preferably 0.1 $g/m^2$ or below, and particularly preferably 0.05 $g/m^2$ or below, down to 3 $mg/m^2$.

Couplers are compounds that react with an oxidized color-developing agent to form a dye.

Couplers include color-forming couplers as mentioned below, that is, compounds capable of forming colors by an oxidation coupling reaction with an aromatic primary amine developing agent (e.g., a phenylenediamine derivative and an aminophenol derivative) in a color-developing process, and, for example, as magenta couplers can be mentioned 5-pyrazolone couplers, pyrazolo-benzimidazole couplers, cyanoacetylcumarone couplers, and open-chain acylacetonitrile couplers, as yellow couplers can be mentioned acylacetamide couplers (e.g., benzoylacetanilides, and pivaloylacetanilides), and as cyan couplers can be mentioned naphthol couplers and phenol couplers.

It is desirable that these couplers are nondiffusible with a hydrophobic group called a ballasting group in the molecule, or that they are polymerized. The couplers may be four-equivalent or two-equivalent to a silver ion. The couplers may be colored couplers having a color-correcting effect or couplers that will release a development restrainer with development (so-called DIR couplers).

The silver chloride emulsion is prepared by mixing a common water-soluble silver salt (e.g., silver nitrate) solution with a water-soluble chloride (e.g., potassium chloride) solution in the presence of a water-soluble polymer solution, such as a gelatin solution.

Preferably the average grain size of the silver chloride grains (in terms of the average grain diameters for spherical grains or nearly spherical grains, or in terms of the average size based on the projected areas for cubic grains, assuming the size of the edge as the grain size) is 2 μm or below, and particularly preferably 0.4 μm or below. The grain size distribution may be narrow or wide.

The shape of the silver chloride grains may be a cubic form, a octahedral form, or a mixture thereof.

Two or more silver chloride photographic emulsions that have been separately prepared may be mixed.

The silver chloride photographic emulsions may be of the type wherein a latent image is formed mainly on the grain surfaces or of the internal latent image type wherein a latent image is formed within the grains. These photographic emulsions can be prepared by techniques described, for example, by Mees in "*The Theory of Photographic Process*" published by Macmillan Co., by P. Glafkides in "*Chimie Photographique*" by P. Glafkides in *Chimie Physique Photographique* (published by Paul Montel Co., 1967), by G. F. Duffin in *Photographic*

*Emulsion Chemistry* (published by The Focal Press Co., 1966), and by V. L. Zelikman et al. in *Making and Coating Photographic Emulsion* (published by The Focal Press Co., 1964). That is, any one of the acid method, the neutral method, the ammonia method, etc. may be employed, and as the method of reacting the soluble silver salt with the soluble halide can be employed either of the single jet method, the double jet method, or a combination thereof.

A method wherein grains are formed in the presence of excess silver ions (the so-called reverse-mixing method) can also be used. As one type of reverse-mixing method, the method wherein the pAg in the liquid phase where the silver chloride will be formed is kept constant, that is, the so-called controlled double jet method, can also be used.

According to this method, a silver chloride emulsion wherein the crystal form is regular and the grain sizes are nearly uniform can be obtained.

Two or more silver chloride emulsions that have been separately formed may be mixed and used.

In the course of the formation of silver chloride grains or the physical ripening thereof, a cadmium salt, a zinc salt, a lead salt, a thallium salt, an iridium salt or its complex salt, a rhodium salt or its complex salt, an iron salt, or an iron complex salt may also be present.

As the silver chloride emulsion, use can be made of an emulsion that has not been chemically sensitized, that is, the so-called primitive emulsion, but usually the silver chloride emulsion is chemically sensitized. For the chemical sensitization, a technique described by Glafkides or Zelikman et al. in the above-mentioned publication, or by H. Frieser in *Die Grundlagen der Photographischen Prozesse mit Silberhalogeniden* (Akademische Verlagsgesellschaft, 1968) can be used.

That is, the sulfur sensitization method that uses active gelatin or a compound containing sulfur reactive with a silver ion, the reduction sensitization method that uses a reducing substance, the noble metal sensitization method that uses a gold or other noble metal compound, etc. may used alone or in combination.

As other additives, a hardening agent, a plasticizer, a lubricant, a surface-active agent, a gloss agent, and other additives known in the field of photographic art may be contained in the photographic element.

As a binding material or a protective colloid of the photographic emulsion, it is advantageous to use gelatin, but other hydrophilic colloids may also be used.

If necessary the photographic emulsion may be spectrally sensitized with cyanine dyes such as cyanine, merocyanine, and carbocyanine that may be used alone or in combination, and such cyanine dyes may be used in combination with styryl dyes.

In the photographic element, the photographic emulsion layer or other hydrophilic colloid layer may contain a brightening agent, for example of the stilbene type, the triazine type, the oxazole type, or the cumarin type. The brightening agent may be soluble in water or insoluble in water, and for water-insoluble brightening agents, they may be used in the form of a dispersion.

The photographic material may contain, as a color fogging-preventive agent, for example a hydroquinone derivative, an aminophenol derivative, a gallic acid derivative, or an ascorbic acid derivative.

A discoloration inhibitor can be additionally used, and one or more image-dye stabilizers may also be used. Known discoloration inhibitors include, for example, hydroquinone derivatives, gallic acid derivatives, p-alkoxyphenolic acid, p-oxyphenol derivatives, and bisphenols.

The photographic layers or other hydrophilic colloid layers of the photographic material to which the present invention will be applied may contain a coating auxiliary, and various surface-active agents for various purposes, for example for antistatic, for improving the slip characteristics, for the emulsification and dispersion, for preventing adhesion, and for improving the photographic characteristics (e.g., acceleration of the development, high contrast, and sensitization).

The development-intensifying solution used in the present invention may contain, in addition to one or more of various developing agents as described above, known developing solution component compounds.

If necessary the development-intensifying solution may further contain, for example, as competing couplers such as citrazinic acid, J-acid, and H-acid, ones described, for example, in JP-B Nos. 9505/1969, 9506/1969, 9507/1969, 14056/1970, and 508/1969, and U.S. Pat. No. 2,742,832, 3,520,690, 3,560,212, and 3,645,737.

In one of the typical processes belonging to the present invention, after a silver chloride color photographic material is exposed to light, the photographic material is developed and intensified, fixed or bleach-fixed (or both bleached and fixed), washed, and dried to give a color image. It is also possible that after the development and intensification, the photographic material may be subjected directly to the process of a stabilizing bath or the washing process without subjecting it to the desilvering process.

In the present invention the term "washing process" has board meaning, to include a stabilizing bath as a substitute for washing, as described above.

The washing process includes a multi bath type washing of the multi-counter current type.

Although since the amount of washing water varies depending on the number of the multi-current washing baths and the amount of the components carried over from the preceding bath, it is difficult to determine the amount of washing water, for 3-tank counter current washing it is preferable that washing water is in an amount of about 1000 ml or more, and more preferably 5000 ml or more, per $m^2$ of photographic material. For case of a water-saved process, it is desirable to use washing water in an amount of 100 to 1000 ml per $m^2$ of photographic material.

The washing temperature is 15° to 45° C., and more preferably 20° to 35° C.

Into the washing process various known compounds may be added to prevent precipitation or to stabilize the washing water. For example, chelating agents such as inorganic phosphoric acid, amino polycarboxylic acids, and organic phosphonic acid; bactericides and mildew-proofing agents for preventing bacteria, algae, or mildew from occurring, for example compounds described in *J. Antibact. Antifung. Agents.* Vol. 11, No. 5, pages 207 to 223 (1983), and compounds described by Hiroshi Hori in "*Bokin to Bobai no Kagaku*"; metal salts such as magnesium salts and aluminum salts; alkali metal salts, and ammonium salts, or surface-active agents for lowering the drying load or for preventing uneven drying may be added as required; and also compounds, for example, described by West in *Photographic Science and Engineering,* Vol. 6, pages 344 to 359 (965) may be added.

To stabilize the image various compounds are added into the stabilizing bath. As typical examples can be mentioned, for example, various buffers for adjusting the film pH, for example, to 3 to 8 (e.g., borates, metaborates, borax, phosphates, carbonates, potassium hydroxide, sodium hydroxide, ammonia water, monocarbcxylic acids, dicarboxylic acids, and polycarboxlic acids that are used in combination), and aldehydes such as formalin. Further, other additives such as chelating agents (inorganic phosphoric acid, aminopolycarboxylic acids, organic phosphonic acid, aminopolyphosphonic acids, and phosphonocarboxylic acids), bactericides (e.g., thiazole-type bactericides, isothiazole-type bactericides, halogenated phenols, sulfanilamide, and benztriazole), surface-active agents, brightening agents, and hardening agents may be used, and two or more compounds for the same or different purposes may be used in combination.

It is preferable to add, as a film pH-adjusting agent of the processor, various ammonium salts such as ammonium chloride, ammonium nitrate, ammonium sulfate, ammonium phosphate, ammonium sulfite, and ammonium thiosulfate, in order to improve the image storage.

According to the present invention, the amount of a processing solution to be used can be reduced by the monobath color-intensifying process without causing the image strengthening effect to lower due to the fatigue of the processing. Further, according to the present invention, even if the coating amount of silver is quite low, a sufficient color image density can be secured, and the amount of processing solution consumed is less, so that the present method is economical. Further, according to the present invention, the number of the steps is small, and therefore a color image can be formed easily and quickly.

Now the present invention will be described with reference to the following examples.

EXAMPLE 1

Silver halide emulsion used in the example of the present invention was prepared as follows:

| | |
|---|---|
| (1st solution) | |
| $H_2O$ | 1000 ml |
| NaCl | 5.5 g |
| Gelatin | 32 g |
| (2nd solution) | |
| Sulfuric acid (1N) | 24 ml |
| (3rd solution) | |
| Solvent for silver halide described below (1%) | 3 ml |

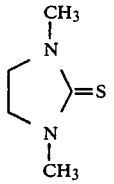

| | |
|---|---|
| (4th soluiton) | |
| KBr | 15.66 g |
| NaCl | 3.30 g |
| $H_2O$ to make | 200 ml |
| (5th solution) | |
| $AgNO_3$ | 32 g |
| $H_2O$ to make | 200 ml |
| (6th solution) | |
| KBr | 62.72 g |
| NaCl | 13.22 g |

-continued

| | |
|---|---|
| $K_2IrCl_6$ | 4.54 ml |
| $H_2O$ to make | 600 ml |
| (7th solution) | |
| $AgNO_3$ | 128 g |
| $H_2O$ to make | 600 ml |

The 1st solution was heated to 56° C. and the 2nd solution and the 3rd solution were added thereto to prepare a mixed solution. Then the 4th solution and the 5th solution were added together to the mixed solution over 30 minutes. After a lapse of 10 minutes, the 6th solution and the 7th solution were added together to the mixed solution over 20 minutes. When five minutes passed after the addition, the mixed solution was cooled and subjected to desalting. Then water and gelatin were added to the solution, the pH of which was then adjusted to 6.2, resulting in a monodisperse cubic silver chloride and bromide emulsion having an average particle size of 0.45 μm and a deviation coefficient (value s/d obtained by dividing the standard deviation by the average particle size) of 0.08 and containing 70 mol % of silver bromide. To the emulsion were added chloroauric acid of $1.0\times10^{-4}$ mol Ag and sodium thiosulfate, and then it was subjected to optimum chemical sensitization.

Then silver halide emulsions (2), (3), (4), (5), and (6) different in content of silver chloride were prepared by varying the amount of KBr and NaCl in the 4th solution and the 6th solution and the time of the addition of the 4th solution and the 5th solution, as shown in Table 1.

Table 2 shows the average particle size, deviation coefficient, and halogen composition of each of the silver halide emulsions (1) to (6).

TABLE 1

| Emulsion | 4th Solution KBr (g) | 4th Solution NaCl (g) | 6th Solution KBr (g) | 6th Solution NaCl (g) | Time of Addition of 4th and 5th Solution (min.) |
|---|---|---|---|---|---|
| (2) | 6.71 | 7.70 | 26.88 | 30.84 | 12 |
| (3) | 3.36 | 9.35 | 13.44 | 37.44 | 10 |
| (4) | 1.12 | 10.45 | 4.48 | 41.85 | 9 |
| (5) | 0.22 | 10.89 | 0.90 | 43.61 | 8 |
| (6) | 0.00 | 11.00 | 0.00 | 44.05 | 8 |

TABLE 2

| Emulsion | Average Gram Size (μm) | Coefficient (s/d) | Deviation Composition of Halogen (%) Br | Cl | Remarks |
|---|---|---|---|---|---|
| (1) | 0.45 | 0.08 | 70 | 30 | Comparative Sample |
| (2) | 0.45 | 0.07 | 30 | 70 | Comparative Sample |
| (3) | 0.45 | 0.07 | 15 | 85 | This Invention |
| (4) | 0.45 | 0.08 | 5 | 95 | This Invention |
| (5) | 0.45 | 0.08 | 1 | 99 | This Invention |
| (6) | 0.45 | 0.08 | 0 | 100 | This Invention |

Then, to 10.0 g of a magenta coupler (a) and 4.1 g of a image-dye stabilizer (b) were added 13.6 ml of ethyl acetate and 10.0 ml of solvent (c) to prepare a solution.

Materials (a) to (c) are described hereinafter. Then the solution was dispersed in 150 ml of 10% aqueous gelatin solution containing 10 ml of 10% sodium dodecylbenzene sulfonate by emulsification.

100 ml of the solution obtained by adding the undermentioned compound (A) to each of the previously-prepared emulsions (1) to (6) in an amount of $2\times10^{-4}$ mol/mol AgX was mixed with 40 ml of the above-described emulsified dispersion to prepare a mixture. Then the mixture was applied onto a substrate to prepare each of Samples 1 to 6.

As the substrate was used a paper of which both surfaces were laminated with polyethylene. The coating amount of the mixture to the paper was so determined that silver, coupler, and gelatin are 0.15 g/m$^2$, 0.38 g/m$^2$ and 1.80 g/m$^2$ in amounts, respectively. A protective layer of gelatin in an amount of 1.50 g/m$^2$ was employed as an uppermost layer. Also, a sodium compound of 1-oxy-3,5-dichloro-s-triazine was used as a gelatin-hardening agent for each layer.

After the exposure the following processing was carried out using an apparatus shown in FIG. 1.

| Processing Step | Temperature (°C.) | Time (min.) |
|---|---|---|
| Monobath developing intensification | 35 | 1 |
| Fixing | 25–40 | 1 |
| Washing | 25–40 | 5 |

The composition of a processing solution used for each processing step was as follows:

| | |
|---|---|
| Developing intensifier | |
| Potassium sulfite | 4 g |
| Tribasic potassium phosphate | 40 g |
| Dibasic potassium phosphate | 6 g |
| 1-Hydroxyethane-1,1-sulfonic acid | 2 g |
| 5-Nitrobenzotriazole | 10 mg |
| 4-Amino-3-methyl-N-ethyl-N-β-(methanesulfonamide) ethylaniline 3/2 sulfate monohydrate | 4 g |
| Hydrogen peroxide (30%) | 20 ml |
| Water to make | 1 l(pH 11.0) |
| Fixing solution | |
| Ammonium thiosulfate | 150 g |
| Sodium silfite | 10 g |
| Sodium bisulfite | 2.5 g |

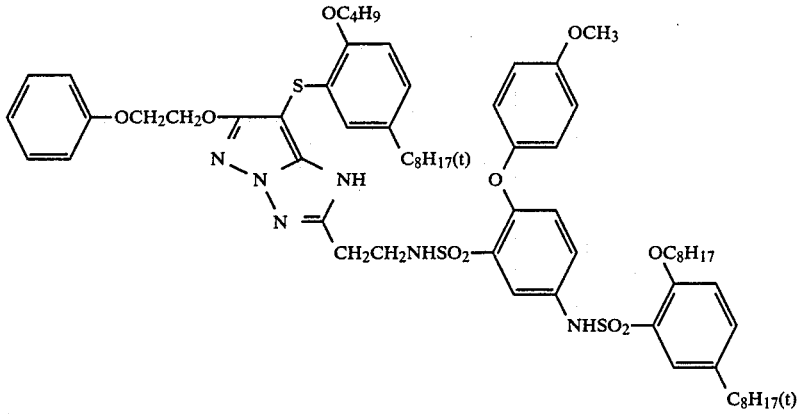

(a) Magenta coupler

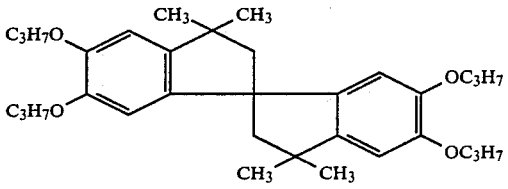

(b) Image-dye stabilizer

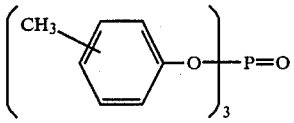

(c) Solvent

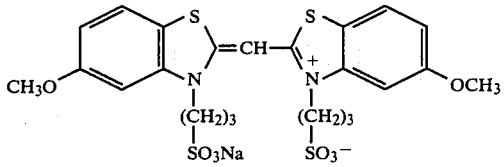

Compound (A)

Samples 1 to 6 described above were subjected to gradation exposure for sensitometry through a sharp cut filter manufactured by Fuji Photo Film Co., Ltd. using an sensitometer (FWH Type, manufactured by Fuji Photo Film Co., Ltd.; color temperature of light source: 3200K). The exposure was carried out for 0.5 second to provide an exposure amount of 250CMS.

-continued

| | |
|---|---|
| Water to make | 1 l(pH 6.0) |

Now the apparatus used for the processing will be described with reference to FIG. 1.

Each sample is adhered onto a guide base (12) at a delivery section (11) and carried through a feed roller (13) to a processing tank (14). The processing tank (14) comprises a gap defined between a rotating drum (15) and a semicircular drum (16) concentrically arranged on the outside of the rotating drum (15), and the thickness of the solution tank is 3 mm. A sample travels half way round the tank (14) over 60 seconds, resulting in it being supplied to a squeeze roller (17). The monobath developing-intensifier is fed from a supply nozzle (18) and discharged from and exhaust port (19). The intensifier is fed at a rate sufficient to cause it to pass through the tank (14) in 240 seconds. In the tank the solution forms a laminar flow free of any turbulence. A sample passing through the squeeze roller (17) is guided through a fixing tank (20), a washing tank (21), and a drying chamber (22), to a take-up roller (23).

The amount of the developing intensifier used corresponds to 750 ml per $m^2$ of the samples of photographic material.

Uneven development and a green filter light density of a magenta-colored image at a maximum density portion were measured in connection with Samples 1 to 6. The results were as shown in Table 3.

TABLE 3

| Sample | Uneven Development | Density (Dmax) |
|---|---|---|
| 1 | Slight | 0.11 |
| 2 | None | 0.25 |
| 3 | None | 1.23 |
| 4 | None | 1.82 |
| 5 | None | 1.90 |
| 6 | None | 1.95 |

From the results shown in Table 3, it was found that Samples 3 to 6 of the present invention, which are considered to contain substantially only silver chloride as silver halide, exhibit considerably high color density, whereas Samples 1 and 2 of silver chloride and bromide for comparison fail to exhibit any color-intensifying effect.

Next these samples were processed in a developing bath using the same processing solution and according to the same procedure. The solution was stored in the bath in an amount sufficient to provide a depth of 15 mm, which corresponded to about 20 per square meter of the sample. Samples (1) to (6) did not exhibit uneven development and had a coloring density between 1.9 and 2.1.

Thus it will be noted that color intensification by solution-saving development capable of decreasing the amount of processing solution is particularly advantageously accomplished by means of a sensitizing material using silver chloride.

EXAMPLE 2

Onto a paper substrate of which both surfaces are laminated with polyethylene layer having titanium dioxide dispersed therein were applied the following first layer (lowermost layer) to sixth layer (uppermost layer), to prepare a color-sensitizing material of a low silver content. An emulsion was prepared in substantially the same manner as the silver chloride emulsion in Example 1, except that the time and temperature for physical ripening were adjusted to finely grain it. ($mg/m^2$ indicates the coating amount of the material.)

| | |
|---|---|
| Sixth layer | Gelatin (1000 $mg/m^2$) |
| Fifth layer | Silver chloride emulsion (AgCl) |
| (Red-sensitive emulsion layer) | (Ag: 5 $mg/m^2$, average grain size: 0.2 $\mu m$) |
| | Gelatin (1000 $mg/m^2$) |
| | Cyanogen coupler (*1) (400 $mg/m^2$) |
| | Coupler solvent (*2) (200 $mg/m^2$) |
| Fourth layer | Gelatin (1200 $mg/m^2$) |
| | Ultraviolet absorbent (*3) (1000 $mg/m^2$) |
| | Dioctylhydroquinone (500 $mg/m^2$) |
| Third layer | Silver chloride emulsion (AgCl) |
| (Green-sensitive emulsion layer) | (Ag: 5 $mg/m^2$, average particle size: 0.2 $\mu m$) |
| | Gelatin (100 $mg/m^2$) |
| | Magenta coupler (*4) (300 $mg/m^2$) |
| | Coupler solvent (*5) (300 $mg/m^2$) |
| Second layer | Gelatin (1000 $mg/m^2$) |
| First layer | Silver chloride emulsion (AgCl) |
| (Blue-sensitive emulsion layer) | (Ag: 8 $mg/m^2$, average particle size: 0.4 $\mu m$) |
| | Gelatin (1200 $mg/m^2$) |
| | Yellow coupler (*6) (300 $mg/m^2$) |
| | Coupler solvent (*2) (150 $mg/m^2$) |

Substrate

Compounds used are as follows:

1 Cyan coupler: 2-[α-(2,4-di-t-aminophenoxy) butaneamido]4,6-dichloro-5-methylphenol
2 Coupler solvent: phthalate-n-butylester
3 Ultraviolet absorbent: 2-(2-hydroxy-3-sec-butyl-5-t-butylphenyl) benzotriazole
4 Magenta coupler: 1-(2,4,6-trichlorophenyl)-3-(2-chloro-5-tetradecaneamido) anilino-2-pyrazoline-5-one
5 Coupler solvent: phosphate-o-cresylester
6 Yellow coupler: α-pivaloyl-α-[2,4-dioxo-5,5'-dimethyloxazolidine-3-yl-2-chloro-5-[α-(2,4-di-t-amylphenoxy) butaneamido]acetanilide Sample A was exposed to light using a sensitometer, and the following processing was carried out for monobath developing intensification using the same apparatus as in Example 1.

| Processing Step | Temperature (°C.) | Time (min.) |
|---|---|---|
| Monobath developing intensification | 35 | 1 |
| Stabilizing bath | 25–40 | 2 |

The composition of a processing solution used for each processing step was as follows:

| | |
|---|---|
| Developing intensifier | |
| Potassium sulfite | 4 g |
| Tribasic potassium phosphate | 40 g |
| Dibasic potassium phosphate | 6 g |
| 1-Hydroxyethane-1,1-sulfonic acid | 2 g |
| 5-Nitrobenzotriazole | 10 mg |
| 4-Amino-3-methyl-N-ethyl-N-β-(methanesulfonamide) ethylaniline 3/2 sulfate monohydrate | 4 g |
| Hydrogen peroxide (30%) | 20 ml |
| Water to make | 1 l(pH 11.0) |
| Stabilizing bath | |

-continued

| | |
|---|---|
| Citric acid | 4 g |
| Sodium sulfite | 0.5 g |
| Sodium citrate | 0.5 g |
| Water to make | 1 l(pH 4.1) |

The obtained sample was free of any uneven development and had excellent highlight portion. Also, it exhibited a sufficient color-intensifying effect as is noted from the fact that the concentration of cyan, yellow, and magenta (red, green, and blue light concentrations) were 1.85, 1.90, and 1.95, respectively.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for forming an intensified color image comprising subjecting an image-wise exposed silver halide color photographic material substantially free from silver iodide as the photosensitive silver halide and containing 80 mol % or more of silver chloride to color-development processing using a monobath development-intensifying solution containing (1) hydrogen peroxide or a compound that releases hydrogen peroxide, (2) a color-developing agent, (3) bromide ions in an amount of $2\times10^{-4}$ mol/l or less, and (4) iodide ions in an amount of $3\times10^{-3}$ mol/l or less, in an amount of 5l to 0.05ll of monobath development-intensifying solution per $m^2$ of the photographic material.

2. The method for forming an intensified color image as claimed in claim 1, wherein the silver halide color photographic material contains 90 mol % or more silver chloride.

3. The method for forming an intensified color image as claimed in claim 1, wherein the silver halide color photographic material contains 95 mol % or more silver chloride.

4. The method for forming an intensified color image as claimed in claim 1, wherein the amount of the monobath development-intensifying solution to be used is from 0.05 l up to 1 l per $m^2$ of the photographic material.

5. The method for forming an intensified color image as claimed in claim 1, wherein the method comprises feeding the monobath development-intensifying solution in a discarding system or a replenishing system.

6. The method for forming an intensified color image as claimed in claim 1, wherein the method comprises feeding the monobath development-intensifying utilizing a laminar flow development, a coating development, a spray development or a thin-layer development.

7. The method for forming an intensified color image as claimed in claim 1, wherein the pH of the monobath development-intensifying solution is 9 or higher.

8. The method for forming an intensified color image as claimed in claim 1, wherein the monobath development-intensifying solution contains (5) nitrogen-containing heterocyclic compound.

9. The method of forming an intensified color image as claimed in claim 1, wherein the monobath development-intensifying solution contains (5) a nitrogen-containing heterocyclic compound selected from the group consisting of (a) 5- or 6-membered heterocyclic compounds containing a nitrogen atom; (b) derivatives of (a) having condensed riots; and (c) nitrogen-containing heterocyclic compounds represented by the following formula (I) and (II):

Formula (I)

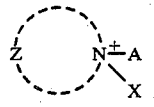

Formula (II)

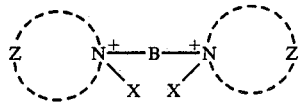

wherein, A represents a substituted or unsubstituted alkyl group, alkenyl group, or alkynyl group having 1 to 5 carbon atoms; an aralkyl group or a cycloaliphatic hydrocarbon group each having 7 to 12 carbon atoms; or a substituted or unsubsituted aryl group having 6 to 12 carbon atoms; B represents a substituted or unsubstituted divalent hydrocarbon group; and Z represents a group of nonmetal atoms necessary to form together with the nitrogen atom a heterocyclic ring.

10. The method of forming an intensified color image as claimed in claim 1, wherein the color-developing agent is selected from the group consisting of a p-phenylenediamine derivative color-developing agent, a onium salt p-aminophenol derivative color-developing agent, a dye developer, a diffusible dye-releasing type (DDR) redox compound, a developing agent reactive with an amidrazone compound, a reducing agent oxidizable to form a dye or a lake, and a reducing agent forming a colored image after oxidation.

11. The method for forming an intensified color image as claimed in claim 1, wherein the coating amount of silver in the photographic material is 1 g/$m^2$ or below.

12. The method for forming an intensified color image as claimed in claim 1, wherein the coating amount of silver in the photographic material is 0.5 g/$m^2$ or below.

13. The method for forming an intensified color image as claimed in claim 1, wherein the amount of the silver iodide is 1 mol % or less of the silver halide.

14. The method for forming an intensified color image as claimed in claim 1, wherein the amount of the color developing agent is $10^{-3}$ mol/l or more.

15. The method for forming an intensified color image as claimed in claim 1, wherein the hydrogen peroxide or the compound that releases hydrogen peroxide is present with the color-developing agent in a molar ratio of the hydrogen peroxide or the compound that releases hydrogen peroxide to the color-developing agent of 0.5:1 to 200:1.

* * * * *